United States Patent [19]

Nitschke et al.

[11] Patent Number: 4,985,966

[45] Date of Patent: Jan. 22, 1991

[54] APPARATUS FOR CLEANING A CARD

[75] Inventors: Heinz Nitschke, Winterthur; Werner Hauschild, Duernten, both of Switzerland

[73] Assignee: Rieter Machine Works, Ltd., Winterthur, Switzerland

[21] Appl. No.: 341,376

[22] Filed: Apr. 20, 1989

[30] Foreign Application Priority Data

Apr. 29, 1988 [CH] Switzerland ..... 01609/88

[51] Int. Cl.[5] ..... D01G 15/76; D01G 15/82

[52] U.S. Cl. ..... 19/107; 19/105

[58] Field of Search ..... 19/105, 107, 115, 83

[56] References Cited

U.S. PATENT DOCUMENTS

| | | | |
|---|---|---|---|
| 2,284,750 | 6/1942 | Landreth | 19/83 |
| 2,857,627 | 10/1958 | Berberich | 19/107 |
| 2,984,263 | 5/1961 | Loepsinger | 19/107 |
| 3,142,856 | 8/1964 | Maguire | 19/107 X |
| 4,198,731 | 4/1980 | Harrison | 19/107 |
| 4,227,285 | 10/1980 | Hamrick | 19/107 |

FOREIGN PATENT DOCUMENTS

| | | |
|---|---|---|
| 0097020 | 9/1986 | European Pat. Off. . |
| 2658441 | 6/1978 | Fed. Rep. of Germany . |
| 2300828 | 9/1976 | France . |

*Primary Examiner*—Werner H. Schroeder
*Assistant Examiner*—Ismael Izaguirre
*Attorney, Agent, or Firm*—Kenyon & Kenyon

[57] ABSTRACT

The cleaning apparatus has an air main mounted on a movable frame which can be brought against the side of a card. The air main includes a plurality of suction orifices which can be brought into registry with deformable air outlets at the side of the card which communicate via air lines with extraction stations of the card.

25 Claims, 3 Drawing Sheets

APPARATUS FOR CLEANING A CARD

This invention relates to an apparatus for cleaning a card.

Heretofore, it has been known to provide cards for the cleaning of impurities from a feed lap. In particular, the impurities which are to be removed by a card are concerned mainly with fine impurities since opening and scutching machines are usually employed to remove coarse impurities from the feed lap upstream of the card. It has also been known to provide cards with various cleaning devices in order to clean the card of any impurities which are removed from the feed lap. To this end, cards have been provided with a number of extraction stations at which impurities are removed from the feed material. The number and nature of such cleaning and extraction stations generally varies with card constructions.

In conventional cards, the waste air of the extraction stations has been passed through flexible hoses to one side of the card and delivered to an enclosure connected with a vacuum source. In such a construction, the waste air is to be removed from the card environment by the vacuum source. However, one disadvantage of such a construction is that relatively long flexible hoses cover much of the side of the card. Hence, when servicing work is to be performed on this side of the card, substantially all of the hoses together with the enclosure must be demounted to provide access for servicing. Another disadvantage resides in the air resistance of the relatively long hoses. In such cases, the hoses may become clogged with impurities over time.

European Patent No. 0097020 describes a carding engine which employs an exhaust duct which can be connected to a source of vacuum and which is connected with air ducts through which air is blown to clean the carding engine. However, such a structure is built into the carding engine and does not provide for ready access to the engine for servicing purposes.

U.S. Pat. No. 4,198,731 describes a cleaning apparatus for a carding machine which includes an elongated plenum which can be removable positioned transversely of the machine. However, such a construction is rather cumbersome and are not readily effective for the interior of the carding machine.

French Patent No. 2,300,828 describes a fixed cleaning arrangement for a card which has similar disadvantages as the cleaning apparatus referenced above.

Accordingly, it is an object of the invention to provide a cleaning apparatus for a card which does not encumber the side of a card for servicing purposes.

It is another object of the invention to provide a cleaning apparatus for a card which enables access for servicing to be gained to the side of the card with reduced manual intervention.

It is another object of the invention to ensure that the air flow resistance throughout the cleaning apparatus of a card remains very low.

It is another object of the invention to provide a cleaning apparatus in which an air main can be readily brought to the side of a card and removed therefrom.

Briefly, the invention provides an apparatus for cleaning a card which includes an air main for removable positioning against one side of a card for drawing a flow of air therethrough and a plurality of suction orifices in the air main positioned for sealing abutment against air outlets of the card for drawing air from within the card.

In accordance with the invention, the air main is mounted on a movable frame, for example, having wheel means for rolling on a floor, so as to be moved from time to time away from the side of the card to permit service access to the card.

The air frame is constructed to have at least one branch in communication with a plurality of suction orifices. In this embodiment, the branch may also have sections of increased cross-sectional flow area for each suction orifice in a direction of air flow to maintain at least a substantially constant air flow therethrough. An adjustable restrictor may also be provided at a distal end of the branch for drawing air into the branch.

The air main may also be constructed with a horizontal part secured to and in communication with a vertical branch. In this embodiment, the horizontal part is of a cross-sectional flow area to maintain an air flow therein which is sufficient to prevent depositing of impurities from the air flow in the horizontal part.

The air main frame may also be provided with guide means for guiding the frame into registry with the side of the card in order to align the suction orifices of the air main with air outlets on the card. In this respect, each air outlet is disposed at the end of an air line extending from an extraction station of the card to the side of the card and may be in the form of an elastic connecting piece which deforms about a respective suction orifice of the air main when the air main is abutted against the card. In another embodiment, each air outlet may be in the form of a trumpet-shaped part having a flexible edge seal which sealingly engages about a respective suction orifice of the air main.

The cleaning apparatus permits the servicing of the card to be greatly simplified while reducing the operating costs of the card because of the reduced air flow resistance.

These and other objects and advantages of the invention will become more apparent from the following detailed description taken in conjunction with the accompanying drawings wherein.

Figure 1:
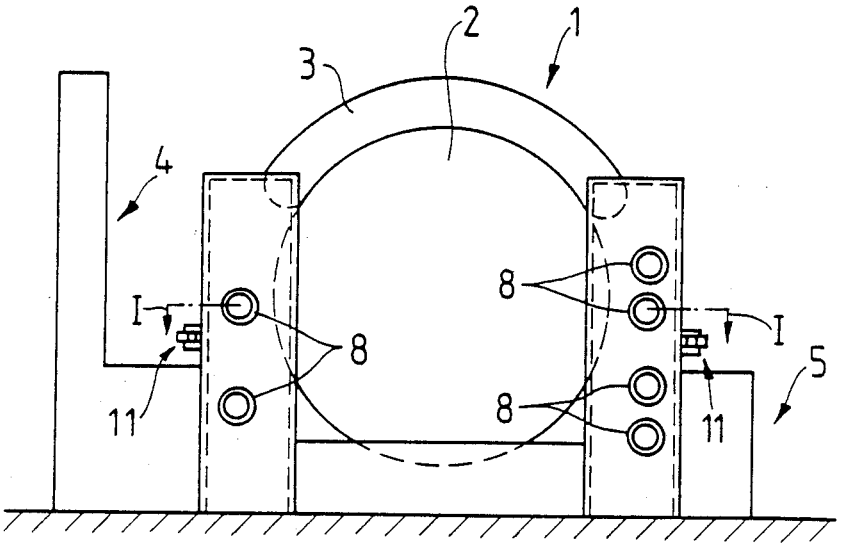
FIG. 1 illustrates a side view of a card constructed in accordance with the invention.

Referring to FIG. 1, the card is constructed in a known manner with a swift 2, a flat 3, a lap feeder 4 and a sliver delivery 5. Since these components are well known in the art, no further description is believed to be necessary. The card 1 is also provided with several extraction stations for the removal of impurities which have been separated out from the material which is processed within the card 1. Again, such extraction stations are well known in the art and need not be specifically defined.

Figure 2:
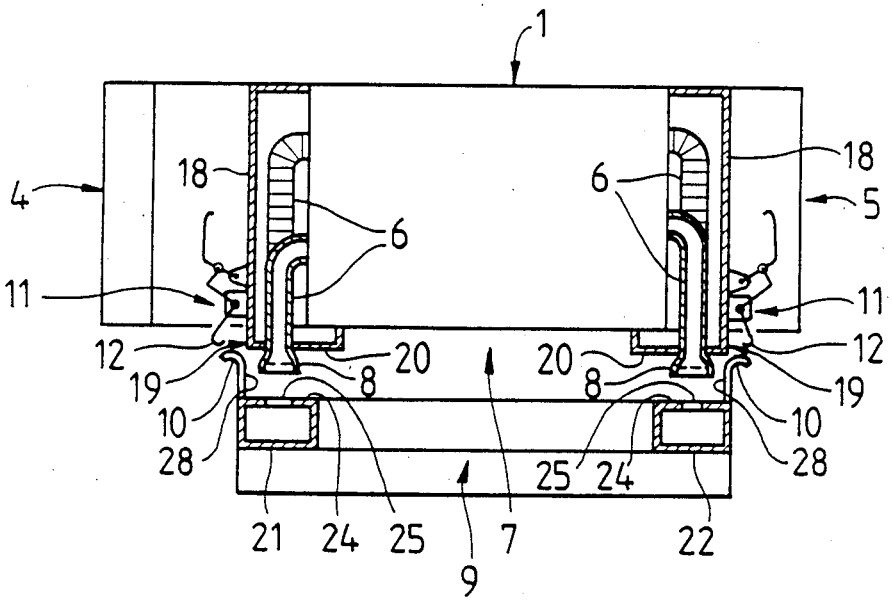
FIG. 2 illustrates a plan view of a cleaning apparatus adjacent the side of a card in accordance with the invention.

Referring to FIG. 2, the cleaning apparatus for cleaning the card 1 employs a plurality of air lines 6, each of which extends from an extraction station to one side 7 of the card 1. In addition, a plurality of air outlets 8 are provided at the side 7 of the card 1, each of which is in communication with a respective air line 6.

Figure 3:
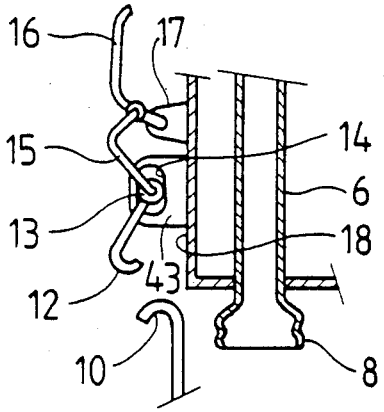
FIG. 3 illustrates a clamping means for securing an air main frame to the side of the card in accordance with the invention.

Referring to FIG. 3, each air outlet 8 is in the form of an elastic connecting piece which can be deformed in a manner as illustrated. For example, the connecting pieces 8 may be made of resilient rubber.

Figure 4:
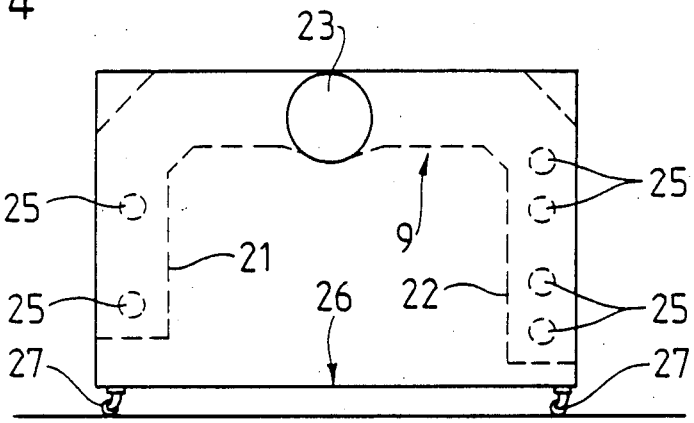
FIG. 4 illustrates an elevational view of an air main mounted on a movable frame in accordance with the invention.

Referring to FIGS. 2 and 4, the cleaning apparatus also employs an air main 9 which is removably positioned at the side 7 of the card 1. The air main 9 is mounted in a movable frame 26 which, in turn, has wheel means 27, such as casters, for rolling on a floor. In addition, the frame 26 is provided with guide elements 28 for guiding the frame 26 into registry with the card 1.

Referring to FIG. 2, two casings 19 are rigidly mounted on the card 1 with each casing 19 housing a plurality of air lines 6 and having a wall 20 from which a plurality of air outlets 8 extend in sealed relation.

To ensure that the air main 9 presses on the elastic connecting pieces 8, a clamping means 11 is mounted on each casing 19 for retaining the air frame 9 against the casing 19. As indicated, each clamping means 11 has a hook 12 for engaging a companion hook 10 extending from a guide element 28 of the air main frame 26.

Referring to FIG. 3, wherein like reference characters indicate like parts as above, each hook 12 of a clamping means 11 is pivotally mounted in a cylindrical bush 13 having a part mounted for movement and rotation in a slideway 14 disposed in a guide element 43 rigidly connected to a wall 18 of a casing 19. That part of the bush 13 which is not guided in the slideway 14 is connected to one end of a rod 15 having an opposite end pivotally mounted in a rocker 16 which, in turn, is pivotally mounted in a support 17 also rigidly connected to the casing wall 18. The clamping means 11 is effective in the manner of a toggle-action fastener. That is, when the rocker 16 is in an operative position and bears on the casing wall 18, the force acting on the hook 12 cannot open the rocker 16. To this end, the rocker 16 has to be opened manually by being pivoted away from the casing wall 18.

Referring to FIG. 4, the air main 9 is provided with a pair of vertical branches 21, 22 each of which is connected via a horizontal portion to a common waste line 23. Each branch 21, 22 has an end wall 24 (see FIG. 5) in which a plurality of suction orifices 25 (see FIG. 4) are provided. Each end wall 24 forms a plane connection surface for the elastic connecting pieces 8 (see FIG. 2).

Referring to FIG. 2, after the air main 9 has been brought into facing relation with the side 7 of the card 1, the movable frame 26 is pushed toward the side 7 of the card 1 with the use of the guide elements 28,. Thereafter, each clamping means 11 is actuated so that the companion hooks 10, 12 are engaged, thereby pressing the air main 9 against the side 7 of the card 1. At the same time, the elastic connecting pieces 8 deform about a respective suction orifice 25. The yielding of each elastic connecting piece 8 is sufficient for satisfactory seal tightness between each connecting piece 8 and a suction orifice 25.

In order to position the air main 9 accurately during the movement of the frame 26, the hooks 10 have a guide surface which is pushed onto the walls 18 of the casings 19 with a reduced clearance of, for example 2 to 3 millimeters.

Figure 5:
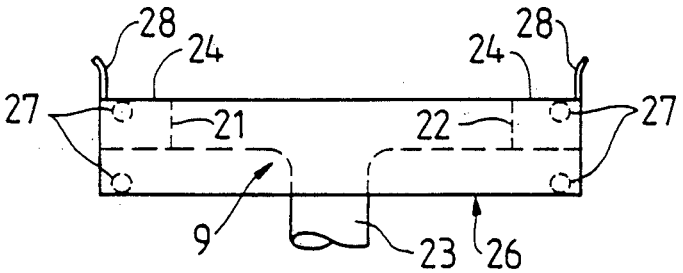
FIG. 5 illustrates a part plan view of the frame of FIG. 4.

Referring to FIGS. 4 and 5, the waste line 23 is connected to an extractor fan (not shown) which delivers the waste air to a filter (not shown). Such a fan and filter are well known and need not be further described. In this respect, the fan and filter may be mounted on the frame 26.

The frame 26 also has grips or handles or the like (not shown) so that the air main 9 can be moved manually from the position shown in FIG. 2 into an operative position in which the end wall 24 engages the elastic connecting pieces 8 in sealed relationship.

Figure 6:
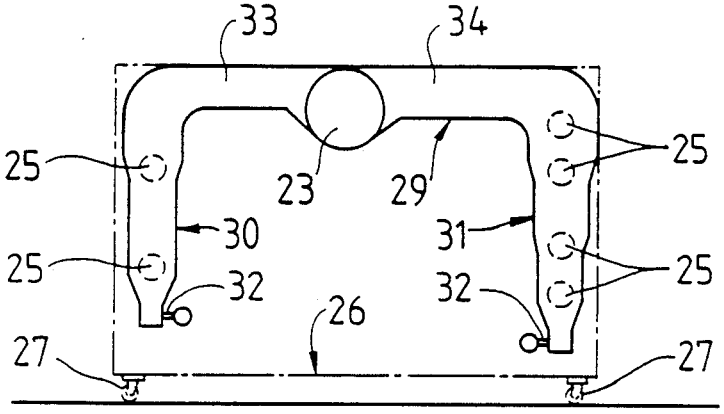
FIG. 6 illustrates an elevational view of a modified air main in accordance with the invention.

Referring to FIG. 6, wherein like reference characters indicate like parts as above, the air main 29 may have vertical branches 30, 31 which have a stepped configuration or which are graded into the direction of the air flow so as to define cross-sectional flow areas to maintain a constant air flow (air speed) throughout the length of the branch. The graduations of the branches 30, 31 may be such that a slight increase in air speed, for example, of 1 meter per second, is produced after each suction orifice 25.

In addition, an adjustable restrictor 32 is provided at a distal end of each branch 30, 31 for selectively drawing air into the respective branches 30, 31. Each restrictor 32 enables a quantity of secondary air to be admitted into each branch 30, 31 in order to prevent material from being deposited in the branch 30, 31. A restrictor 32 of this kind enables the air speed in each branch to be accurately adjusted to suit requirements.

The air main 29 is also constructed with a horizontal portion 33, 34 between each branch 30, 31 and the waste line 23 which is of a cross-section flow area to prevent depositing of impurities from the air flow passing therethrough. That is, each horizontal portion 33, 34 may have a cross section which guarantees that the air speed in each portion does not fall below a predetermined speed necessary to ensure that the impurities do not precipitate from the air flow and stick to the wall of the horizontal portions 33, 34.

Figure 7:
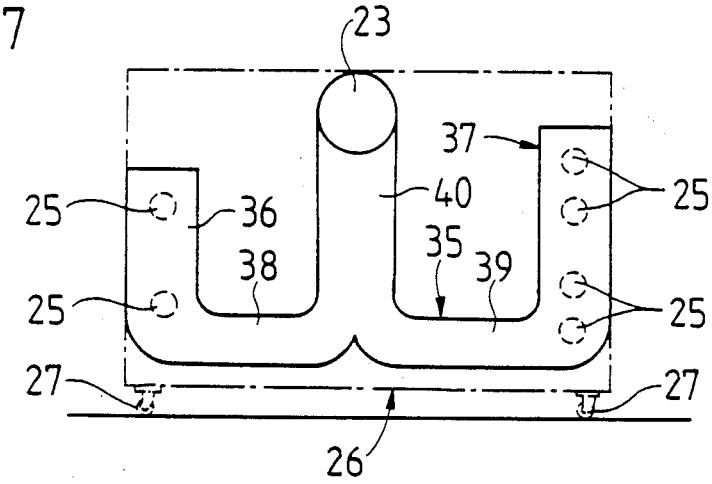
FIG. 7 illustrates a view of a further modified air main in accordance with the invention.

Referring to FIG. 7, wherein like reference characters indicate like parts as above, the air main 35 may be constructed so that two vertical branches 36, 37 extend upwardly from horizontal portions 38, 39 so that the air flow and, therefore, the impurities which separate out are conveyed downwardly. In this case, there is no risk that impurities in the air flow will deposit on the walls of the branches 36, 37. In addition, as with the embodiment of FIG. 6, the horizontal portions 38, 39 have a cross section which ensures that the impurities are not separated out to remain behind in the horizontal portions 38, 39.

As illustrated, the horizontal portions 38, 39 of the air main 35 communicate with a common riser 40 which extends to the waste line 23.

While the air main is illustrated as being mounted on a frame 26 which is movable on a floor via casters 27, the air main may also be pivotally mounted on the side of the card in order to pivot on a horizontal axis, for example upwardly, away from the side of the card so as to permit access to that side of the card.

Figure 8:
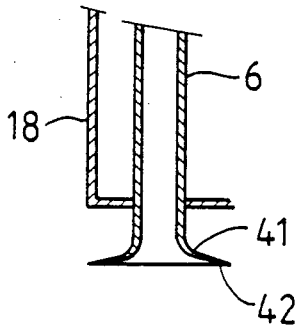
FIG. 8 illustrates a modified air outlet in accordance with the invention.

Referring to FIG. 8, each air outlet on an air line 6 may be in the form of a trumpet-shaped part 41 having a flexible edge seal 42 for sealingly engaging about a respective suction orifice 25 (not shown) of an air main. In this respect, the clamping means 11 may be omitted because the edge seal 42 engages the end wall 24 (not shown) of an air main in a sealed manner when there is a negative pressure in the suction system.

The invention thus provides a cleaning apparatus which can be readily moved against and away from the side of a card while at the same time providing for a sealed connection between air outlets on the card and suction orifices of the air main. In addition, the air main can be constructed with flow cross-sectional areas to preclude depositing out of impurities within the air main, thereby, increasing the useful life of the cleaning apparatus.

What is claimed is:

1. An apparatus for cleaning a card, said apparatus comprising an air main for removable positioning against one side of a card for drawing a flow of air therethrough;

a plurality of suction orifices in said air main positioned for sealing abutment against air outlets of the card for drawing air from within the card; and a movable frame having said air main mounted thereon and wheel means on said frame for rolling said frame from the card.

2. An apparatus as set forth in claim 1 which further comprises a movable frame having said air main mounted thereon and wheel means on said frame for rolling on a floor.

3. An apparatus as set forth in claim 1 wherein said air main has at least one branch in communication with a plurality of said suction orifices, and wherein said branch line has sections of increased cross-sectional flow area in a direction of air flow to maintain at least a substantially constant air flow therethrough.

4. An apparatus as set forth in claim 3 which further comprises an air inlet at a distal end of said branch for drawing air into said branch, said inlet having an adjustment restrictor.

5. An apparatus as set forth in claim 3 wherein said air main has a horizontal part secured to and in communication with said branch of a cross-sectional flow area to maintain an air flow therein sufficient to prevent depositing of impurities from the air flow in said horizontal part.

6. An apparatus as set forth in claim 5 wherein said branch is vertically disposed and said horizontal part has a smaller cross-sectional flow area than said vertical branch.

7. An apparatus as set forth in claim 3 wherein said branch is vertically disposed with a distal end disposed above a proximal end to convey air downwardly therein.

8. In combination a card having a plurality of air extraction stations for cleaning of said card;

a plurality of air lines extending from said stations to one side of said card;

a plurality of air outlets, each outlet being in communication with a respective air line at said side of said card; and an air main pivotally mounted on said card at said side of said card to pivot on a horizontal axis away from side, said main having a plurality of suction orifices, each said orifice being positioned in sealing abutment with a respective air outlet of said card for drawing air from within said card.

9. The combination as set forth in claim 8 wherein each air outlet is an elastic connecting piece disposed in deformed relation about a respective suction orifice of said air main.

10. The combination as set forth in claim 8 wherein each air outlet is a trumpet-shaped part having a flexible edge seal sealingly engaging about a respective suction orifice of said air main.

11. The combination as set forth in claim 8 wherein said air main has a pair of vertically disposed branches and a common waste line connected to said branches, each said branch having a plurality of said suction orifices therein.

12. The combination as set forth in claim 8 which further comprises a movable frame having said air main mounted thereon and guide elements on said frame for guiding said frame into registry with said card.

13. The combination as set forth in claim 12 wherein said frame has wheel means thereon for rolling on a floor.

14. The combination as set forth in claim 8 which further comprises at least one casing on said card having a plurality of said air outlets therein.

15. The combination as set forth in claim 18 which further comprises clamping means mounted on said casing for retaining said air frame against said casing with said air outlets and suction orifices in sealed relation.

16. The combination as set forth in claim 8 wherein said air main has an air inlet at a distal end for selectively drawing air into said air main, and an adjustable restrictor in said air inlet.

17. An apparatus for cleaning a card, said apparatus comprising an air main for removable positioning against one side of a card for drawing a flow of air therethrough;

a plurality of suction orifices in said air main positioned for sealing abutment against air outlets of the card for drawing air from within the card; and a movable frame having said air main mounted thereon and wheel means on said frame for rolling on a floor.

18. An apparatus for cleaning a card, said apparatus comprising an air main for removable positioning against one side of a card for drawing a flow of air therethrough;

a plurality of suction orifices in said air main positioned for sealing abutment against air outlets of the card for drawing air from within the card;

said air main having at least one vertically disposed branch in communication with a plurality of said suction orifices with sections of increased cross-sectional flow area in a direction of air flow to maintain at least a substantially constant air flow therethrough and a horizontal part secured to and in communication with said vertical branch, said horizontal part having a smaller cross-sectional flow areaw than said vertical branch to maintain an air flow therein sufficient to prevent depositing of impurities from the air flow in said horizontal part.

19. An apparatus for cleaning a card, said apparatus comprising an air main for removable positioning against one side of a card for drawing a flow of air therethrough;

a plurality of suction orifices in said air main positioned for sealing abutment against air outlets of the card for drawing air from within the card; and said air main having at least one vertical branch in communication with a plurality of said suction orifices, and wherein said branch line has sections of increased cross-sectional flow area in a direction of air flow to maintain at least a substantially constant air flow therethrough and having a distal end disposed above a proximal end to convey air downwardly therein.

20. In combination a card having a plurality of air extraction stations for cleaning of said card;

a plurality of air lines extending from said stations to one side of said card;

a plurality of air outlets, each outlet being in communication with a respective air line at said side of said card and being a trumpet-shaped part having a flexible edge seal;

an air main removably positioned at said side of said card, said main having a plurality of suction orifices, each said orifice being positioned in sealing abutment with a said flexible edge seal of a respective air outlet of said card for drawing air from within said card.

21. In combination a card having a plurality of air extraction stations for cleaning of said card;

a plurality of air lines extending from said stations to one side of said card;

a plurality of air outlets, each outlet being in communication with a respective air line at said side of said card; and an air main removably positioned at said side of said card, said main having a plurality of suction orifices, each said orifice being positioned in sealing abutment with a respective air outlet of said card for drawing air from within said card, said air main having a pair of vertically disposed branches and a common waste line connected to said branches, each said branch having a plurality of said suction orifices therein.

22. The combination as set forth in claim 21 wherein each branch has a stepped configuration to define cross-sectional flow areas to maintain a constant air flow therein.

23. The combination as set forth in claim 22 wherein said air main has a horizontal portion between each branch and said waste line of a cross-sectional flow area to prevent depositing of impurities from the air flow passing therethrough.

24. The combination as set forth in claim 21 wherein said air main has a horizontal portion between a lower end of each branch and said waste line whereby air flows downwardly in each branch.

25. In combination a card having a plurality of air extraction stations for cleaning of said card;

a plurality of air lines extending from said stations to one side of said card;

a plurality of air outlets, each outlet being in communication with a respective air line at said side of said card;

an air main removably positioned at said side of said card, said main having a plurality of suction orifices, each said orifice being positioned in sealing abutment with a respective air outlet of said card for drawing air from within said card; and a movable frame having said air main mounted thereon and guide elements on said frame for guiding said frame into registry with said card.

* * * * *